United States Patent [19]

Fluhrer et al.

[11] Patent Number: 5,074,281

[45] Date of Patent: Dec. 24, 1991

[54] CIRCUIT ARRANGEMENT FOR THE CONTROL OF A VENTILATOR

[75] Inventors: Henry Fluhrer, Nuremburg; Erwin Potthof, Rothenbach, both of Fed. Rep. of Germany

[73] Assignee: Diehl GmbH & Co., Fed. Rep. of Germany

[21] Appl. No.: 648,183

[22] Filed: Jan. 31, 1991

[30] Foreign Application Priority Data

Feb. 21, 1990 [DE] Fed. Rep. of Germany ..... 4005363

[51] Int. Cl.[5] ..... F24C 15/20

[52] U.S. Cl. ..... 126/299 D; 126/299 R

[58] Field of Search ..... 126/299 R, 299 D, 299 F

[56] References Cited

U.S. PATENT DOCUMENTS 3,625,135 12/1971 Carlson .

*Primary Examiner*—Carroll B. Dority

*Attorney, Agent, or Firm*—Scully, Scott, Murphy & Presser

[57] ABSTRACT

A circuit arrangement for the control of a ventilator, especially for a stream or vapor vent hood which is located above a cooking range, in dependence upon steam or vapor clouds which are drawn towards the ventilator. An ultrasonic transmission path having an ultrasonic transmitter and an ultrasonic receiver is located in front of the ventilator, with a receiving circuit demodulating the signal which appears at the ultrasonic receiver; wherein an evaluating or sample-and-hold circuit evaluates any fluctuations in the input signal encountered over a period of time and which are based on the presence of steam or vapor clouds in the ultrasonic transmitting path, and counts these signals within a time frame, and wherein a comparator circuit compares the result of the count with preset values and, in accordance therewith, activates the ventilator.

9 Claims, 2 Drawing Sheets

CIRCUIT ARRANGEMENT FOR THE CONTROL OF A VENTILATOR

BACKGROUND OF THE INVENTION

1. Field of the Invention

The present invention relates to a circuit arrangement for the control of a ventilator, especially for a steam or vapor vent hood which is located above a cooking range, in dependence upon steam or vapor clouds which are drawn towards the ventilator. 2. Discussion of the Prior Art A vapor or steam vent hood with a controllable blower motor is described in the disclosure of German Laid-Open Patent Appln. 30 39 346 A1. Arranged on this hood is a sensor element which is responsive to moisture and/or steam and and/or smoke and/or heat. This sensor element; for example, may consist of a moisture probe, a temperature probe or a probe which is responsive to particles.

In the disclosure of German Published Patent Appln. 25 18 750 there is described a steam vapor vent hood, whose ventilator is activated in dependence upon a temperature differential which is present between the temperature of the cooking vapors and the temperature of the surroundings thereof.

The disclosure of German Petty Patent 76 33 882 pertains to a steam or vapor vent hood, whose ventilator is activated through the intermediary of a moisture probe.

In the disclosure of U.S. Pat. No. 3,625,135 there is described a steam or vapor vent hood, whose ventilator is activated in dependence upon particles which are encountered in the cooking vapors.

It has been evidenced in the technology that a temperature-dependent control of the ventilator is subject to problems inasmuch as the temperature in the steam or vapor clouds which are present in the region of the steam vent hood is not so significantly higher than the temperature of the surroundings so as to enable this differnece to be easily employed for the control of the ventilator. Moisture probes or particle probes or sensors also do not lead in a simple manner to the desired control. In addition thereto, such probes are complex and expensive in their construction.

In accordance with the disclosure of German Patent 32 45 302, the steam or vapor vent hood is not controlled in dependence upon the steam or vapor clouds which are drawn towards the ventilator. In contrast therewith, the steam vent hood is controlled through the intermediary of a photoelectric sensor by means of a photoelectric signal transmitter on the cooking range.

SUMMARY OF THE INVENTION

Accordingly, an object of the present invention is to contemplate the provision of a circuit arrangement of the above-mentioned type in which the steam clouds can be detected in a simple and assured manner, and permit themselves to be utilized for the activation of the ventilator.

Inventively, the above-mentioned object is attained through the utilization of a circuit arrangement of the above-mentioned type in that an ultrasonic transmission path having an ultrasonic transmitter and an ultrasonic receiver is located in front of the ventilator with a receiving circuit demodulating the signal which appears at the ultrasonic receiver; wherein an evaluating or sample-and-hole circuit evaluates any fluctuations in the input signal encountered over a period of time and which are based on the presence of steam or vapor clouds in the ultrasonic transmitting path, and counts these signals within a time frame, and wherein a comparator circuit compares the result of the count with preset values and, in accordance therewith, activates the ventilator.

It has been found that the cooking procedure on a cooking range leads the formation of inhomogeneities in the air in the region about the steam vent hood due to the development of steam or vapor and fume clouds, in essence, the forming of steam, vapor and/or heat. Furthermore, it has been ascertained that such inhomogeneities or strias of the air significantly influence the characteristics in the propagation or spreading of ultrasound. This can be traced back to the aspect that the inhomogeneities of the air which represent the fluctuations in the density of the air lead at the boundary surfaces to dispersions or dissipations of the sound pursuant to the law of refraction.

Consequently, the presence of inhomogeneities in the air in the ultrasonic transmitting path has as a consequence rapidly vacillating attenuations or dampings of the ultrasonic signal within a period of time in which is received by the ultrasonic receiver.

The receiving circuit demodulates the signal which appears at the ultrasound receiver in such a manner that, in the presence of an undisturbed ultrasonic transmitting path there is obtained a constant or uniform remaining receiving signal. It has been evidenced that this receiving signal significantly oscillates or fluctuates when steam, fumes or vapor clouds, which are encountered in the ultrasonic transmitting path, irrespective as to whether formed by steam, vapor fumes and/or heat; while in contrast therewith only slow fluctuation in the receiving signal are caused by other movements of the ambient air. In effect, steam or vapor clouds produce a superimposed wave component in the receiving signal.

The evaluating or sample-and-hold circuit evaluates the timewise rapid oscillations or; in essence, the superimposed wave component of the receiving signal. Thereby, pulses are generated which are counted within a specified time frame. The applicable or obtained result in the count corresponds to the intensity of the steam cloud formation which is present. A more intense steam or vapor cloud formation leads to a higher count result.

By means of the comparator circuit, the count result is compared with preset values. In accordance with the comparative results, the ventilator, is either switched on or off, particularly in a stepwise operating mode.

Concurrently with actuation of the ventilator, there can also be switched on an optical display.

BRIEF DESCRIPTION OF THE DRAWINGS

Advantageous embodiments of a circuit arrangement for the control of a ventilator pursuant to the invention may now be more readily ascertained from the following detailed description of an exemplary embodiment thereof, taken in conjunction with the accompanying drawings; in which.

DETAILED DESCRIPTION

Figure 1:
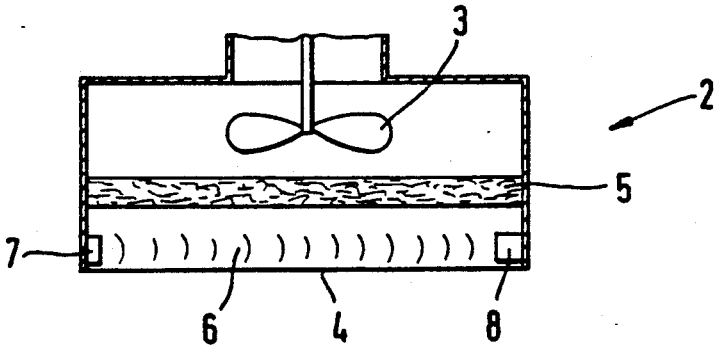
FIG. 1 illustrates generally diagrammatically a steam or vapor vent hood which is arranged above a cooking area.

A steam or vapor vent hood 2 which is located above a cooking area 1 possesses a ventilator 3. A filter mat 5 is positioned intermediate an aspirating or suction grate 4 of the steam vent hood 2 and ventilator 3. Arranged intermediate the filter mat 5 and the aspirating grate 4 is a ultrasonic transmitting path 6. The latter is formed by an ultrasonic transmitter 7 and an ultrasonic transmitter 8.

The ultrasonic transmitter 7 operates; for example, at a frequency of 200 kHz. Connected to the output of the receiver 8 is an amplifier and a demodulator 9. At the output of the demodulator there appears the demodulated receiving signal Ua. This signal is conducted to an evaluating circuit 10, which has its output connected to a comparator circuit 11.

The transmitter 7 is not required to operate in continuous operation. The transmitter can be operated in a pulsed operation. In that particular instance, the transmitter and the receiver can be constructed from the same component. Consequently, for the circuit arrangement it is only necessary to provide a single ultrasonic component.

The receiving signal Ua is applied within the evaluating circuit 10 to comparators 12, 13. Moreover, the receiving signal Ua is applied to a timing element 14 which is formed from impedances R1, R2 and a capacitance C. The timing element generates an average or median follow-up signal level Un which is delayed in time with respect to the receiving signal Ua. Certain superimposed wave components of the receiving signal Ua are smoothed in the follow-up level Un.

Figure 3A:
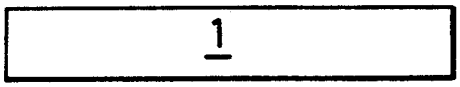
FIGS. 3*a* and 3*b* illustrate plots of signal curves.
Figure 3A:
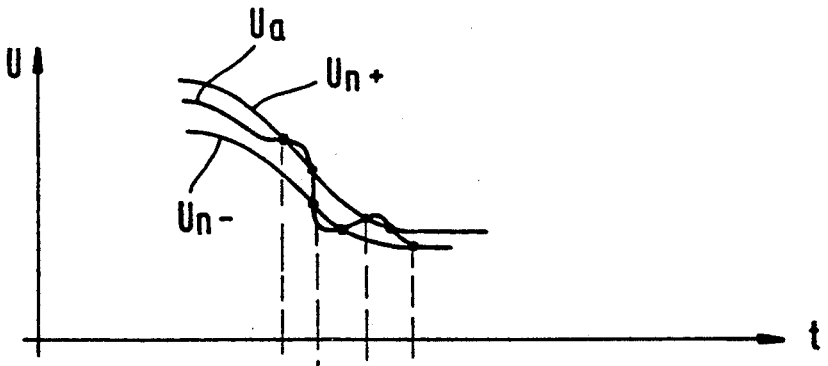

The average follow-up signal level Un is presently applied to the one input of two differential amplifiers 15, 16, at which other inputs thereof there are presently connected variable impedances R3 or, respectively, R4. As a result thereof, obtained at the output of the differential amplifer 15 is a positive switching level Un+, which is applied to the other input of the comparator 12. At the output of the differential amplifier 16 there is generated a negative switching level Un−, which is applied to the other output of the comparator 13. In FIG. 3*a* there is represented a receiving signal Ua which; for example, is generated in response to the presence of steam or vapor clouds in the ultrasonic transmitting path 6 during a short period of time. In addition, there is also represented the positive switching level of Un+ and the negative switching level Un− which are obtained from this receiving signal Ua.

The output of the comparator 12 is connected to a setting input of a flip-flop 17. The output of the comparator 13 is connected to a resetting input of the flip-flop 17.

Figure 3B:
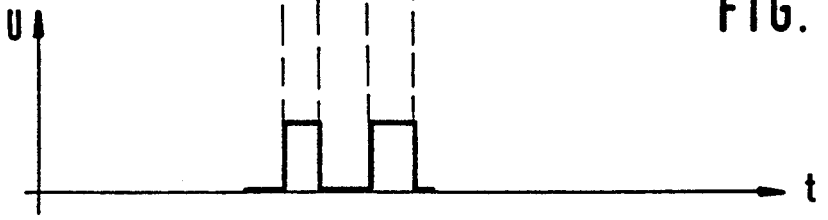
Figure 2:
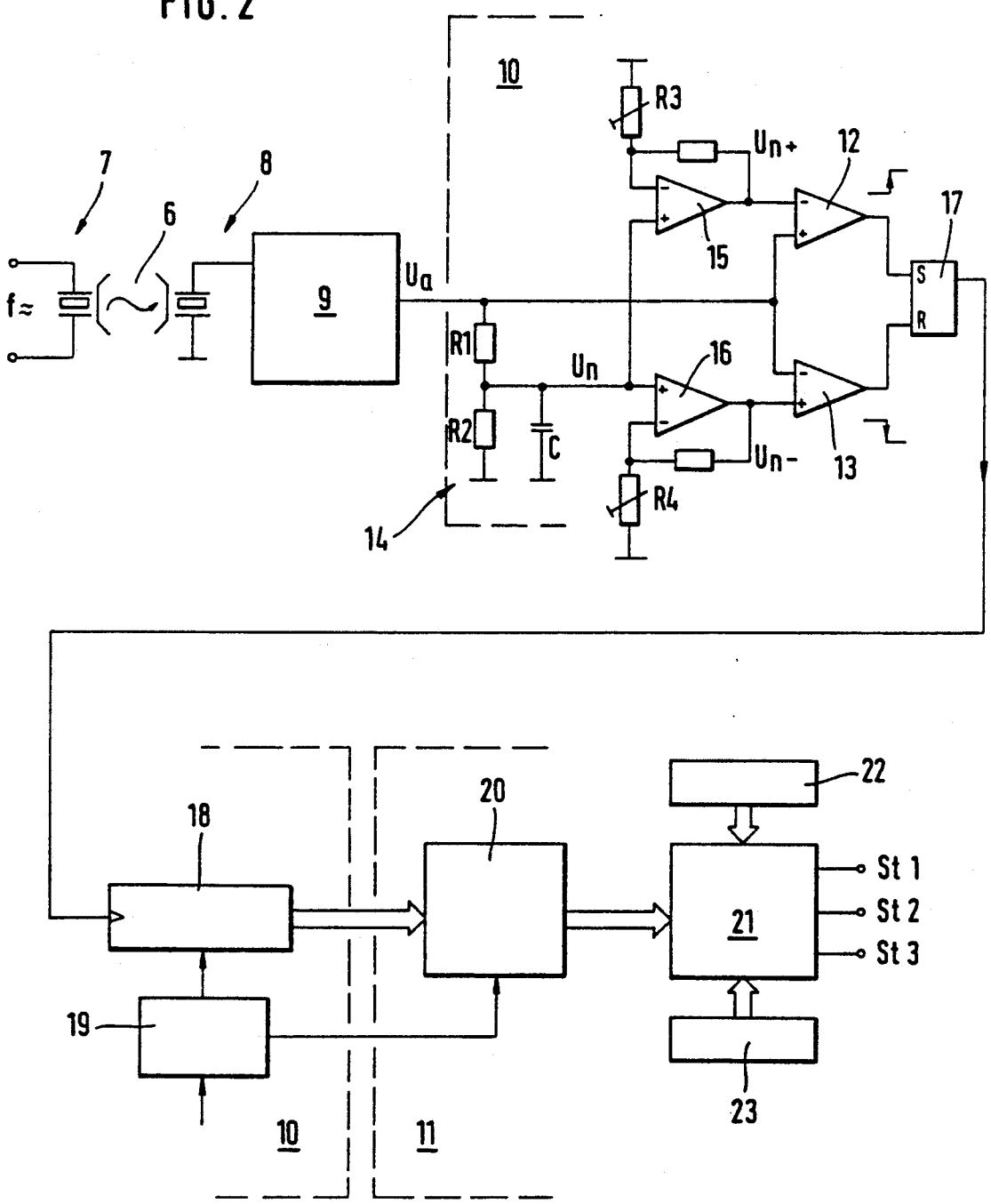
FIG. 2 illustrates a block circuit diagram of a circuit arrangement for the steam or vapor vent hood.

When the receiving signal Ua intersects the positive switching level Un+, then a setting pulse is generated at the flip-flop 17. When the receiving signal Ua intersects the negative switching level Un−, then a resetting pulse is generated at the flip-flop 17. From this there is obtained a pulse sequence at the output of the flip-flop 17 (as shown in FIG. 3*b*). In FIG. 3*b*, there are represented only two such pulses. The smaller the hysteresis between the positive switching level Un+ and the negative switching level Un−, are there detected the finer amplitude fluctuations in the receiving signal Ua; in effect, leading to the generating of pulses at the output of the flip-flop 17. The magnitude of this hysteresis is proportional to the absolute level of the receiving signal Ua. As a result, there is afforded an extensively uniformly remaining sensitivity, even when the receiving signal Ua weakens during the course of time due to unavoidable contaminations or fouling of the transmitter 7 and of the receiver 8.

The time constant for the timing element 14 is selected in such a manner that it will detect the superimposed wave component of the receiving signal Ua which is caused by the steam or vapor clouds. When the time constants are selected so as to be substantially higher, then there are also detected motions of the ambient or surrounding air.

The number of pulses of the flip-flop 17 are counted into a counter 18. This counter is always again reset by means of a synchronizing or pulsing circuit 19 after a certain period of time (time frame). The time frame; for example, may consist of about 20 seconds.

The count result obtained within the applicable time frame is stored in interim memory 20 of the comparator circuit 11. This count result, in certain instances, is cyclically erased by means of the pulsing circuit 19 through a loop connection.

A comparator logic 21 assumes the applicable count result from the an interim memory storage 20. Applied to the comparator logic 21, on the one side, are the activating parameters by means of a coding switch 22, and on the other side, the deactivating parameters by means of a logic switch 23. With the comparator logic 21 there are to be activated, for example, three switching steps St1, St2, St3 for the ventilator 3. Through the determination of the activation parameters there is specified at which magnitude should the interim storage or memory 20 activate either the step St1, or Step St2, or Step St3. The deactivating parameters determine at which magnitude should the interim memory 20 switch the ventilator 3*b* down. Through the different selection for the respective activation and the deactivation magnitudes, there can be attained a desired hysteresis for the switching behavior of the ventilator 3.

It has been ascertained that by means of the described circuit arrangement, the ventilator 3, in response to the more intensively encountered steam or clouds during a cooking procedure, will automatically switch upwardly into its three operating steps, and at a reducing intensity in the formation of steam or vapor clouds will again switch downwardly until reaching a standstill in operation.

What is claimed is:

1. Circuit arrangement for the control of a ventilator, particularly in a steam or vapor vent hood which is located above a cooking range, in dependence upon steam clouds drawn towards said ventilator, an ultrasonic transmission path including an ultrasonic transmitter and an ultrasonic receiver being positioned in front of said ventilator; a receiving circuit demodulating a signal appearing at said ultrasonic receiver; an evaluating circuit evaluating fluctuations in the receiving signal encountered over a period of time wherein the fluctuations are predicted on the steam or vapor clouds encountered in the ultrasonic transmission path and counts said fluctuations within a time frame; and a comparator circuit comparing the count result with specified values and activates the ventilator in accordance therewith.

2. A circuit arrangement as claimed in claim 1, wherein the ultrasonic transmission path is located in front of a filter mat arranged in the steam vent hood, said ventilator been arranged behind said filter mat.

3. A circuit arrangement as claimed in claim 1, wherein said comparator circuit activates the ventilator in a plurality of switching steps.

4. A circuit arrangement as claimed in claim 1, wherein said evaluating circuit a positive and a negative switching level from said receiving signal over a period of time which is delayed relative to said receiving signal; a first comparator at an equality of the positive switching level with a superimposed wave component of the receiving signal conducting a setting pulse to a flip-flop; and a second comparator at an equality of the negative switching level with the superimposed wave component of the receiving signal conducting a resetting pulse to the flip-flop.

5. A circuit arrangement as claimed in claim 4, wherein a counter counts the pulses of the flip-flop received within said time frame.

6. A circuit arrangement as claimed in claim 4, wherein a timing element generates a follow-up signal level from the receiving signal which is delayed and smoothed relative to the superimposed wave component; and differential amplifiers forming from said follow-up level said positive and negative switching levels.

7. A circuit arrangement as claimed in claim 1, wherein an interim memory storage of the comparator circuit receives the count result from the counter, said interim memory storage being connected to a comparator logic having said specified values transmitted thereto through a coding switch.

8. A circuit arrangement as claimed in claim 7, wherein said coding switch facilitates the setting of specified values for the activation and for the deactivation of a plurality of switching steps for the ventilator.

9. A circuit arrangement as claimed in claim 7, wherein said comparator logic controls a display indicative of the operative switching condition of the ventilator.

* * * * *

UNITED STATES PATENT AND TRADEMARK OFFICE

CERTIFICATE OF CORRECTION

PATENT NO. : 5,074,281

DATED : December 24, 1991

INVENTOR(S) : Henry Fluhrer, et al.

It is certified that error appears in the above-identified patent and that said Letters Patent is hereby corrected as shown below:

On the Title Page, Section [75]: "Nuremburg" should read as --Nurnberg--.

In the Abstract, line 2: "stream" should read as --steam--.

Column 1, line 17: after "steam" delete --and-- (first occurrence).

Column 1, line 41: "differnece" should read as --difference--.

Column 3, line 39: "amplifer" should read as --amplifier--.

Column 4, line 60, Claim 1" "predicted" should read as --predicated--.

Signed and Sealed this

Fourth Day of May, 1993

*Attest:*

*Attesting Officer*

Michael K. Kirk

MICHAEL K. KIRK

*Acting Commissioner of Patents and Trademarks*